United States Patent [19]

Kremr et al.

[11] 3,947,316

[45] Mar. 30, 1976

[54] METHOD OF PREPARING THE BACKER FOR THE MANUFACTURE OF MAN-MADE LEATHER

[75] Inventors: Milan Kremr; Václav Hrabovsky, both of Otrokovice, Czechoslovakia

[73] Assignee: Statni vyzkumny ustav kozedelny, Gottwaldov, Czechoslovakia

[22] Filed: Dec. 21, 1971

[21] Appl. No.: 210,562

Related U.S. Application Data

[63] Continuation-in-part of Ser. No. 845,893, July 29, 1969, abandoned, and a continuation-in-part of Ser. No. 850,236, Aug. 14, 1969, Pat. No. 3,652,381.

[30] Foreign Application Priority Data

Aug. 16, 1968 Czechoslovakia ..... 5939-68
June 27, 1968 Czechoslovakia ..... 4726-68

[52] U.S. Cl. ..... 162/129; 162/132; 162/143; 162/144; 162/168 N; 427/323; 427/389

[51] Int. Cl.[2] ..... D21F 11/00

[58] Field of Search ..... 162/2, 132, 143, 144, 151, 162/168, 129; 117/140 R, 140 A; 427/323, 389

[56] References Cited

UNITED STATES PATENTS

| | | | |
|---|---|---|---|
| 3,026,242 | 3/1962 | Emery et al. | 162/144 |
| 3,294,579 | 12/1966 | Tu | 162/144 |
| 3,542,910 | 11/1970 | Barash et al. | 162/144 |
| 3,652,381 | 3/1972 | Kremr | 162/2 |

FOREIGN PATENTS OR APPLICATIONS

| | | |
|---|---|---|
| 14,235 | 8/1889 | United Kingdom |

*Primary Examiner*—S. Leon Bashore
*Assistant Examiner*—Peter Chin
*Attorney, Agent, or Firm*—Muray Schaffer

[57] ABSTRACT

A method of preparing a backer for use in the production of man-made leather containing from 20 to 50% by weight of tanned collagen fibrous material.

7 Claims, No Drawings

METHOD OF PREPARING THE BACKER FOR THE MANUFACTURE OF MAN-MADE LEATHER

BACKGROUND OF INVENTION

The present invention is a continuation-in-part of copending U.S. Ser. No. 845,893, filed July 29, 1969 now abandoned and Ser. No. 850,236, filed Aug. 14, 1969 now U.S. Pat. No. 3,652,381.

The present invention relates to a method of preparing the backer for the manufacture of man-made upper or fancy leather containing collagen fibers.

At the present time hygienic man-made leather is being introduced all over the world as a substitute for natural leather. In some cases man-made leather has such qualities that it actually has begun to compete with natural leather.

Owing to a considerable development and increasing production and use of synthetic fibers in the developed countries, the manufacture of man-made leather has concentrated only on the synthetic fibers as a basic material.

The first phase of the manufacture is textile processing. A one or multi-component fibrous mixture is first opened and then a web is produced on orthodox or unorthodox machines. The web is then reinforced in needle punching machines. As the majority of production methods has been developed with the use of contractable or uncontractable fibers, it is necessary after punching to shrink the fibrous backer in special machines. This backer is then impregnated by various methods and finally an artificial grain is applied.

However, leather made from pure synthetic materials has many drawbacks. The main drawback of synthetic leather is a very bad sorption and desorption, and a low shape adaptability to a foot. These factors deter the consumers from buying footwear made of such materials even if the footwear is sold at moderate prices.

More recently, development has led to the use of the synthetic fibers which are mixed in certain proportion with tanned leather fibers, and then, they are processed in an analogous textile method. The combination of synthetic and leather fibers substantially improves the hygienic properties of man-made leathers, but their price increases disproportionally. This is due mainly to the fact that the price of leather fibers is higher than that of synthetic fibers. Moreover, the preparation of leather fibers is considerably laborious. In the production of leather fibers and of the backer, it is impossible to elminate the so-called knops, conglomerates and knots which in the finishing process cause unevenness of the grain side.

Many methods of preparing a leather backer directly from collagen solutions as well as using synthetic webs have been described in the literature. However, generally no improved practical application has been made of such methods and these developments have remained essentially theoretical only.

In so far as practical utilization is concerned, the greatest success has been achieved with the production of a backer in which a web made of polypropylene, viscose or other synthetic fibers is covered with a formaldehyde pre-tanned suspension of fine collagen fibers of microscopic size, the suspension then being pressed or vacuum sucked into the interfibrous spaces of the web. However, in order to obtain a sufficient content of collagen fibers in the web, the coating process must be repeated several times. Thus, this method of production is time-consuming, and therefore, uneconomical.

Accordingly, the object of the present invention is to overcome the prior difficulties and disadvantages by providing an improved method of making a backer for man-made leather, which method is simple and economical.

SUMMARY OF THE INVENTION

In accordance with the present invention, the foregoing object is generally accomplished by utilizing a method of preparing a backer for the production of man-made upper or fancy leather containing collagen fibers, which method is characterized in that swollen collagen fibrous material is applied on one or both sides of a textile screen and the fibrous material is covered with another textile screen; the assembly thus formed is wetted by saturated salt solution, preferably a sodium chloride solution or a finely ground salt is sprinkled thereon; the assembly is gradually pressed to complete compression of the fibrous material; the assembly is subjected to needle punching in wet condition with the total solids of the compressed fibrous material ranging from 20 to 50%; and the assembly is tanned and subsequently dried.

DESCRIPTION OF THE PREFERRED EMBODIMENTS

According to the invention, a textile screen is covered from one or from both sides with swollen collagen fibrous material which, contiguously, is covered with another textile screen, and the resulting assembly then is wetted with the saturated salt solution, mainly with the solution of sodium chloride, or it is sprinkled with said salt being in finely ground condition to bring down the material, and then it is gradually pressed to complete compression of the collagen fibrous material. The assembly is subjected to punching in wet condition with the total solids of the collagen fibrous material ranging from 20 to 50% weight, and finally, it is tanned by chrome, aluminum or zircon salts, or by tanning agents or aldehydes followed by a drying process.

A collagen backer used for the production of man-made upper and fancy leather can be prepared in such a way that a textile screen made of synthetic or natural material is unwound on an endless band. The swollen collagen fibrous material is applied on said screen and another textile screen from synthetic or natural material is then unwound on the collagen fibrous material to serve as a covering layer in the resulting assembly.

In the present invention, the textile "screen" which serves as a reinforcing layer is to be understood to include traditional thin fabrics, i.e., woven fabrics, knitted fabrics or tulles, and non-traditional fabrics, i.e., non-woven fabrics which can be stitched through, impregnated or reinforced in advance.

The thus prepared assembly of swollen collagen fibrous material both sides of which are covered with textile screens is salted by wetting it with saturated solution of salts, e.g., sodium chloride salt, or sprinkling on it finely ground salts, and then is gradually pressed to complete compression and partial de-watering of the swollen collagen fibrous material, preferably to the total solids thereof ranging from 20 to 50% by weight.

To the thus prepared assembly of the collagen fibrous material with the textile screen, a web or layer is applied on one or both sides, which web is prepared either from polyamide, polypropylene, polyester, viscose or other staple fibers, or from cotton and wool or from a mixture thereof. Also, the square weight of the added web depends on the final thickness of the finished leather.

After the web has been applied, the assembly of collagen fibrous material with textile screens is fed through the system of needle punching machines where the fibrous web is interwoven through the collagen fibrous material provided with textile screens.

The punching is carried out in a condition when the compressed collagen fibrous material contains 50 to 80% by weight of moisture. In this condition, very prefect interweaving and compacting of the collagenous backer is accomplished devoid of the knops, conglomerates or other uneven spots on the surface of the backer, whereby a backer having an absolutely smooth surface is obtained.

The non-tanned, compressed collagen fibrous material contains 50 to 80% of moisture and is very elastic. After the needle punching with the fibers is finished, collagen fibrous material immediately closes and shrinks to tighten the bundle of fibers drawn into the hole by punching with the needle. Thus, a certain strain of fibers occurs after passing through the leather substance. The needle interweaving of textile fibers with the collagen material can be attained under certain conditions of punching, e.g., the type of felting needle, depth and number of punches per $cm^2$. Since the processing of very wet salty material causes the corrosion of grids and felting needles, chromium or nickel-plated needles are employed.

After punching, through-out, tanning follows by concentrated chrome liquor in the amount which corresponds to 2% by weight of $Cr_2O_3$ calculated on the pelt weight. Having passed through the chrome liquor, the assembly of interwoven collagen backer is wound on a roller and is conditioned for 24 hours. During this period the liquor penetrates through the whole thickness of the backer and tans the latter uniformly. Having been tanned, the backer is unwound from the roller, passes under sprays of water or through a water bath where the remainder of salts are washed out, and further it passes through the through-feed press and then through the drier. After drying, the material is impregnated by polyurethanes or latices. However, for certain types of leather the backer can be used without impregnation. Thereafter, an artificial grain is applied on the impregnated collagen backer by directly adhering thereon a ready made grain side sheet or a conventional leather finish is applied to the backer.

The swollen collagen fibrous material can be prepared from leather splits as well as from machine glue stock. However, the machine glue stock must be degreased before the proper processing.

The leather splits or the degreased machine glue stock are washed, delimed, bated and pickled. After pickling, the disintegration is carried out in disintegrators with an excess of water. Before the disintegration the leather splits are cut into smaller pieces. The method of proper preparation of the fibrous material in which the collagen fibers have high strength and are free from the brittleness characteristic of the best collagen fibers available heretofore can be obtained from tannery waste, such as split hide and glue stock, when the raw material, while substantially free from line, is pickled in a liquor of 130 – 170% water, 3 – 6% sodium chloride, and 0.8 to 3.0% of a strong inorganic or organic acid whose anion is inert to the collagenous substrate. The percentage figures in this application, unless explicitly stated otherwise, are based on the weight of the tannery waste material, employed as the source of collagen, when containing up to about 70% water. The method of the invention results in collagen fibers of high quality, and fibers thus produced may be used, for instance, in the manufacture of high grades of artificial leather and textile products.

When pickling is carried out until equilibrium between the pickled material and the liquor is reached, as indicated by the absence of further pH changes in the pickling liquor, the waste material loses water to the liquor and absorps acid in such a ratio that its weight is reduced to 95 to 75% of the pelt weight. Equilibrium is reached when the pH of the pickling liquor is approximately between 2.6 and 3.6.

The pickled material is then mechanically disintegrated in the presence of a large excess of water, whereby it is swelled to at least 200% of its original weight, and usually to as much as 400%. When the swollen mass is contacted with an inorganic salt solution, such as that of a soluble chloride or sulfate of an inert cation, it loses enough water to permit further processing in a conventional manner, for example, the further removal of water by contact with air at ambient or elevated temperature, and division into fibers from which hat felt or upholstery stuffing may be prepared, or which may be bonded to make a material suitable for shoe uppers or converted to fabric.

The chemical nature of the acid employed in the important pickling step is not critical. It should be a strong acid which ionizes completely or practically completely at the necessary concentration indicated above. The preferred inorganic acid is sulfuric acid, and the preferred organic acid is formic acid, but other acids of similar strength whose anions are inert to the collagenous material may be substituted at higher cost.

The acid present in the pickled waste material enhances the subsequent swelling of the collagenous material when in contact with water while being disintegrated. The salt content of the pickling liquor must be held at not more than 6% because it would otherwise interfere with the swelling of the fibers during disintegration in the presence of water. A minimum of 3% sodium chloride in the pickling liquor is essential for proper acid absorption and for the desired shrinkage of the raw material.

Because a shrinking step precedes the swelling and disintegration, only the surface strata of the fibers are fully swollen, thereby permitting easy separation of the fibers without breaking them, while the original, unswollen condition still prevails in the core and protects the fibers against breaking into shorter sections or a shortening of average fiber length.

The disintegrated mass may be homogenized and portions of its water content removed by contact with a solution of a soluble sulfate, chloride, or like inorganic salt which precipitates the collagen molecules of high molecular weight while albumin and other proteinaceous material of smaller molecular weight, if not removed by preceding steps, remain in solution.

Further processing of the collagenous material of the invention follows conventional procedures. The water resistance of the fibers may be improved by tanning, using chromium salts or synthetic tanning agents. As other collagen fibers, the materials of the invention are capable of being treated with cationic or non-ionic fat-liquoring agents. Pre-tanning with synthetic tanning agents in amounts of about 5% prevents curling of the fibers in subsequent chrome tanning.

The following examples further illustrate the formation of the collagen material.

EXAMPLE A

Cowhide splits, mainly taken from the shoulder and belly parts of the hide and still containing some lime, were received from the tannery. They were washed in running water in a rotating drum for 20 minutes, and the water was then drain from the drum. It was replaced by 200% fresh water containing 2% ammonium sulfate, and rotation of the drum was resumed for about 3 to 4 hours. All percentage figures relate to the pelt weight of the starting material.

Lime was completely removed from the material by treatment with ammonium sulfate solution which was thereafter drained and washed out with running water for 20 to 30 minutes. As much of the washing water as possible was removed from the drum, and a solution of 4% sodium chloride in 150% water was rotated with the delimed material for 15 minutes, whereupon 2.5% formic acid diluted with five weights of water were added in two batches without stopping rotation of the drum.

The pH of the pickling liquor reached a stable value of 3.2 to 3.4 in about 3 to 4 hours, indicating completion of the pickling process. The pickled hide material was then removed from the drum, permitted to drain for about 1 hour, cut into pieces approximately 4 inches square, and separated into fibers on a disintegrator while suspended in approximately four weights of water which was continuously renewed.

The collagen fibers so obtained were homogenized with water and again precipitated from the homogenized suspension by adding 15% sodium chloride. The precipitated material was separated from the supernatant aqueous phase and tanned with a reduced chromium liquor to a $Cr_2O_3$ content of 2%.

With respect to the purpose of use, preliminary modifications can be made before application of swollen collagen fibrous material on the textile screens and before forming the collagen backer when using fibrous webs. Thus, it is possible to add salts to swollen collagen fibrous material, namely, up to such amount so as not to cause the salting out of collagen fibrous material, e.g., 4% by weight at the maximum. This addition of salt speeds the complete salting out and the bringing down of the swollen fibrous material after it is applied on the screen. It is possible to mix into the swollen collagen fibrous material short textile fibers which improve the three-dimensional interweaving of fibers in the collagen backer after punching. Also, it is possible to mix finely ground chrome shavings into the material which considerably speeds the salting out and prevents adherence and stiffening of the collagen fibers in the drying process. In some cases, it is possible to add into the swollen collagen fibrous material binders such as latex, acrylate, isocyanate and the like in the form of their monomers or polymers, and fat-liquoring can be formed by the addition of non-ionic or cation active fat-liquoring agents directly to the plumped or swollen collagen fibrous material.

The composition of individual layers of collagen backers is selected with respect to the use of man-made leathers produced from these backers. Therefore, the leather for fancy goods will have backer layers of a different composition than the leathers for shoemaking, upholstery and other purposes.

The composition of textile screen and web is optionally chosen from various fibrous materials, again with respect to the ultimate use of the finished man-made leather. All known fibers can be used, such as polyamide, polypropylene, polyester, polyacrylonitrile and viscose fibers in the staple form. Cotton, wool, hackled flax or mixtures of these fibers also can be used.

The examples which follow are illustrative of the present invention.

EXAMPLE 1

A textile screen, which is a thin fabric made of 300 denier polyamide silk with a warp set of 50 threads and a weft set of 40 threads per 10 cm, is unwound onto an endless belt. The swollen collagen fibrous material of the total solids of 8% by weight prepared from split leather is applied on the screen. The applied layer of the swollen collagen fibrous material is 6 mm thick. This layer is covered with an identical textile screen and is wetted by a saturated solution of sodium chloride which causes the bringing down of the collagen fibrous material, and the surplus liquid is removed by a set of pressing rollers where a partial de-watering occurs to the total solids of 35% by weight and compression of the layer of collagen fibrous material.

To the thus partially de-watered assembly of the brought down collagen fibrous material there is applied on both sides a fibrous web having a square weight of 150 g/m² prepared from a mixture comprising 50% by weight of 4 denier, 65 mm polypropylene staple and 50% by weight of 3.5 denier, 60 mm viscose staple. Gradual punching follows on an aggregate of needle punching machines from above and from below until 450 punches per cm² are obtained. Chrome-plated felting needles are used. The speed of feeding the collagen backer is 3 m/min. The punched assembly of the collagen fibrous material and synthetic fibers is fed through the solution of concentrated reduced chrome liquor. In passing through, an amount of chrome liquor adheres to the surface of the backer which corresponds to 2% by weight of $Cr_2O_3$ counted on pelt weight. Having passed through the chrome bath, the collagen backer is wound on a roller and is conditoned for 24 hours. During this period the chrome liquor penetrates through the whole thickness of the backer and tans the latter uniformly. After having been tanned, the collagen backer is unwound from the roller, passes through the washing bath in order to wash out the surplus salts. It then passes through a through-feed press and through a fat-liquoring bath which contains the emulsion of non-ionic fat-liquoring agent in a concentration which is sufficient that after another pressing 4% by weight of fat-liquoring agent should remain in the collagen backer.

Then drying follows after which thermal shrinkage of the synthetic fiber by hot air is carried out at the temperature of 110°C. for 20 sec. The resulting backer is then impregnated by latices and is dried again. After drying it is buffed and finished by leather finishing methods.

EXAMPLE 2

A textile screen which is a fibrous web made of the mixture of 60% by weight of polyamide and 40% by weight of viscous staple is unwound onto an endless belt, the web being mechanically reinforced and having the square weight of 100 g/m². On the screen is applied the swollen collagen fibrous material of the total solids of 8% by weight prepared from machine glue stock. The applied layer of the swollen collagen fibrous material is 9 mm thick. The applied layer is covered with an identical textile screen and is wetted by a saturated solution of sodium chloride which causes the bringing down of the collagen fibrous material and the surplus liquid is removed by a set of pressing rollers where a partial de-watering occurs to provide an assembly having total solids of 40% by weight.

To the thus partially de-watered assembly of the brought down collagen fibrous material there is applied on both sides a fibrous web having a square weight of 120 g/m² prepared from the mixture comprising 40% by weight of polymide staple (4 den., 65 mm) and 60% by weight of viscose staple (3.5 den., 60 mm). The assembly is reinforced by punching on an aggregate of needle punching machines alternatively from above and from below until the total number of 300 punches per cm² have been attained. For punching, chrome-plated felting needles are used each of them having 3 prickles on only two edges spaced 60° and 180° apart from the locking foot.

The remaining operations are identical as in the Example 1 except that the fat-liquoring step is not performed with machine glue stock.

EXAMPLE 3

A textile screen which is a mechanically reinforced non-woven web made of the mixture of 70% by weight of polypropylene staple and 30% by weight of viscose staple of the square weight of 100 g/m² is unwound onto an endless band. On the screen is applied a layer of plumped or swollen collagen fibrous material prepared from machine glue stock into which 50% by weight of finely disintegrated chrome shavings has been mixed in advance. This mixture has total solids of 10% by weight. The applied layer is 5 mm thick. The applied layer is covered with textile screen made of a web reinforced on one side by a binder such as polyvinyl chloride latex. The web has a square weight of 100 g/m² and is made from 100% of viscose staple (3.5 den., 60 mm). This assembly is then wetted by saturated solution of sodium chloride which causes the bringing down of collagen fibrous material and the surplus liquid is removed by a set of pressing rollers where a partial de-watering occurs to the total solids of 40% by weight.

The de-watered assembly is then punched from one side only, i.e., from the side of collagenous material where the binder is placed with the binding film on the collagenous material. The total number of punches is 200/cm². Nickel-plated needles were used provided on two edges 60° and 180° apart from the locking foot with prickles which interweave the fibers when the needle plate moves from above downwards. On one edge distanced 300° from the locking foot, the needles are provided with prickles which interweave the fibers during the reverse movement of the needle plate, i.e., from the bottom upwards.

The remaining operations are identical as in Example 1 except that fat-liquoring step is not performed with machine glue stock.

EXAMPLE 4

A textile screen which is a tulle made of propylene silk is unwound onto an endless band. On the screen is applied a layer the plumped or swollen collagen fibrous material prepared from leather splits having the total solids of 8% by weight. The applied layer of swollen collagen fibrous material is 6 mm thick. The screen with the layer of the swollen collagen fibrous material is wetted by saturated solution of sodium chloride which causes the bringing down of the collagen fibrous material. The surplus liquid is removed by a set of pressing rollers where a partial de-watering occurs to the total solids of 35% by weight.

To the thus partially de-watered band of the brought-down collagen fibrous material provided with one textile screen only is added a web prepared from 100% of polyester staple (1.5 den., 40 mm), having a square weight 150 g/m². The web is applied from that side on which is the textile screen. To the other side of the collagen fibrous material a web is applied prepared from 100% of viscose staple (2.75 den., 40 mm) having a square weight 150 g/m². This assembly is then punched on an aggregate of needle punching machines until a total number of 300 punches per cm² are obtained.

The remaining operations are identical as those in Example 1.

SUMMATION

The method according to the present invention eliminates to a great extent the textile processing of the collagen fibrous material, such as opening, carding and shrinking. Thus, the whole production cycle of the preparation of collagen backers is considerably simplified and less expensive. Also, the preparation of the collagen backers is simplified, which enables all the steps of the whole process to be arranged in a flow line. The collagen backer made in accordance with the method of the present invention does not show the non-disintegrated shivers of collagen fibers on its surface, such as knops, conglomerates and knots. The collagen backers also show higher parameters in some physical and mechanical properties than the backers according to textile methods, and its hygienic properties are nearly equal to the hygienic properties of natural leather.

We claim:

1. A method of preparing a backer for the production of man-made upper or fancy leather containing collagen fibers, comprising the steps of preparing a porous textile screen, swelling substantially untanned collagen fibrous material in an aqueous solution, said swollen collagen fibrous material being of a size capable of being retained on the surface of said screen, depositing said swollen collagen fibrous material on at least one side, salting the assembly thus formed, gradually pressing said collagen and said screen to the complete compression of the collagen fibrous material, covering said collagen fibrous material after compression thereof with a web comprising material selected from the group consisting of synthetic fibers, natural fibers and their mixtures, subjecting said covered assembly to needle punching in wet condition to drive the fibers of said collagen fibrous material into the pores of said screen so that the content of the collagen fibrous material ranges from 20 to 50% by weight of the total solids and thereafter tanning and drying the covered assembly.

2. A method according to claim 1, including the step of admixing with the swollen collagen fibrous material short fibers selected from the group consisting of synthetic fibers and natural fibers in the form of staple or waste fibers.

3. A method according to claim 1 including the step of admixing finely ground chrome shavings with said swollen collagen fibrous material.

4. A method according to claim 1, including the step of admixing a binder material selected from the group consisting of latex, acrylates, isocyanates and their monomers and polymers to the swollen collagen fibrous material.

5. A method according to claim 1, including the step of admixing with said collagen fibrous material a fat-liquoring agent selected from the group consisting of non-ionic and cation active fat-liquoring agents, in the amount of 4% calculated by weight on the total solids of the collagen fibrous material.

6. The method according to claim 1 wherein said tanning comprises the steps of soaking the assembly of the collagen fibrous material and screen in a solution of chrome liquor having a concentration of chrome of about 2% by weight of the assembly, winding said assembly on a roll and maintaining the assembly soaking for about 24 hours, thereafter washing the salts and soaking solution from the assembly and drying the assembly.

7. The method according to claim 1 wherein the density of said punching is at least 200 punches per square centimeter.

* * * * *